United States Patent [19]

Wislocki et al.

[11] Patent Number: 4,845,771

[45] Date of Patent: Jul. 4, 1989

[54] EXPOSURE MONITORING IN RADIATION IMAGING

[75] Inventors: Nicholas C. Wislocki, North Royalton; Susan L. Fike, Euclid, both of Ohio

[73] Assignee: Picker International, Inc., Cleveland, Ohio

[21] Appl. No.: 67,923

[22] Filed: Jun. 29, 1987

[51] Int. Cl.[4] ..... H05G 1/42

[52] U.S. Cl. ..... 378/97; 378/117; 378/108

[58] Field of Search ..... 378/97, 108, 117, 118

[56] References Cited

U.S. PATENT DOCUMENTS

| | | | |
|---|---|---|---|
| Re. 26,497 | 12/1963 | Splain | 378/97 |
| 2,486,866 | 11/1949 | Morgan et al. | 378/97 |
| 3,444,379 | 5/1969 | Bergson | 250/207 |
| 3,600,584 | 8/1971 | Schneble | 378/97 |
| 3,752,991 | 8/1973 | Slagle | 378/97 |
| 3,906,233 | 9/1975 | Vogel | 378/97 |
| 4,087,686 | 5/1978 | Schmitmann | 378/117 |
| 4,121,104 | 10/1978 | Richter | 378/97 |
| 4,178,508 | 12/1979 | Hotta et al. | 378/97 |
| 4,230,944 | 10/1980 | Wiegman et al. | 378/97 |
| 4,250,103 | 2/1981 | Vatne et al. | 378/97 |
| 4,309,612 | 1/1982 | Aichinger | 378/108 |
| 4,309,613 | 1/1982 | Brunn et al. | 378/97 |
| 4,313,055 | 1/1982 | Richter et al. | 378/97 |
| 4,454,606 | 6/1984 | Relihan | 378/97 |
| 4,590,603 | 5/1986 | Relihan et al. | 378/108 |

*Primary Examiner*—Craig E. Church
*Assistant Examiner*—John C. Freeman
*Attorney, Agent, or Firm*—Watts, Hoffmann, Fisher & Heinke

[57] ABSTRACT

A system and method for monitoring progress of a radiographic exposure is disclosed. The system samples the cumulative radiation as an exposure progresses, and aborts the exposure if the rate of rise in cumulative radiation is insufficiently low to cause a good exposure. Similarly, the system will terminate an exposure early, at a properly timed out interval, even if the radiation accumulation rises excessively fast due to an erroneous system set up.

16 Claims, 6 Drawing Sheets

Fig. 1
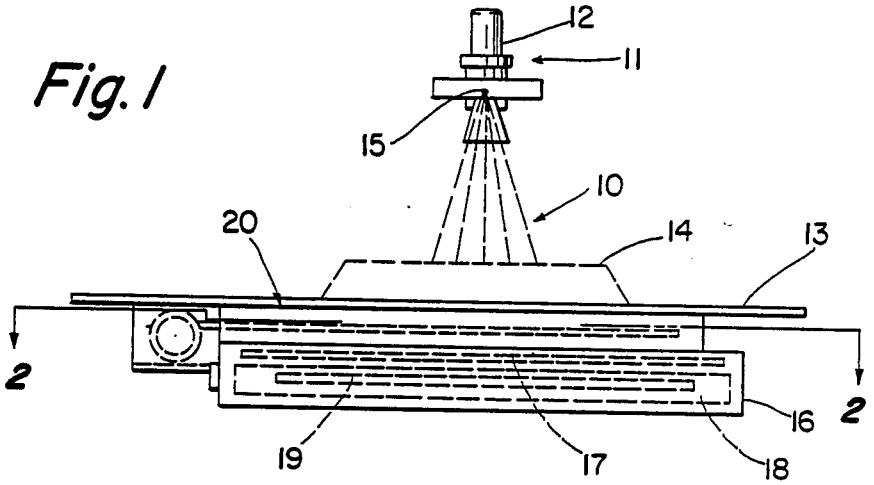
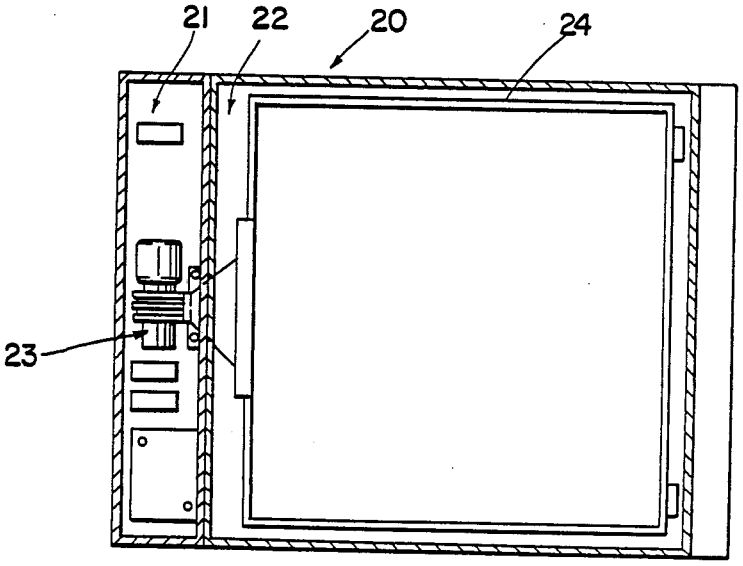
Fig. 2

(SEE FIG. 8)

(FIGURE 6 OF U.S. PAT. NO. 3,752,991)

(SEE FIG. 8)

| | |
|---|---|
| $V_1 - V_0 > 40$ MV RAMP MOVING | EXPOSURE CONTINUE |
| $V_2 - V_1 > 40$ MV RAMP MOVING | EXPOSURE CONTINUE |
| $V_3 - V_2 > 40$ MV RAMP MOVING | EXPOSURE CONTINUE |
| $V_4 - V_3 > 40$ MV RAMP MOVING | EXPOSURE CONTINUE |
| . | |
| . | |
| . | |
| $V_N - V_{N-1} > 40$ MV RAMP MOVING | EXPOSURE CONTINUE |
| $V_{N+1}$ RAMP STOP | EXPOSURE TERMINATION |

| | |
|---|---|
| $V_1 - V_0 >$ 40 MV RAMP MOVING | EXPOSURE CONTINUE |
| $V_2 - V_1 >$ 40 MV RAMP MOVING | EXPOSURE CONTINUE |
| $V_3 - V_2 >$ 40 MV RAMP MOVING | EXPOSURE CONTINUE |
| $V_4 - V_3 <$ 40 MV RAMP NOT MOVING | EXPOSURE ABORT @ $T_4$ |

EXPOSURE MONITORING IN RADIATION IMAGING

TECHNICAL FIELD

This invention relates generally to the field of imaging by use of penetrative radiation, and more particularly to apparatus and method for monitoring progress of an x-ray exposure and for aborting the exposure upon the occurrence of a predetermined amount of deviation from a predetermined standard of radiation accumulation of the cumulative monitored x-ray exposure.

BACKGROUND ART

Radiographic imaging employs a source of penetrative radiation, such as an x-ray tube, and a means responsive to x-rays to indicate characteristics of a pattern of x-rays emergent from a subject when placed in the x-ray beam path between the source and the x-ray sensitive means. The x-ray sensitive means can take many forms, such as an x-ray screen, for converting x-rays to light, overlying a piece of light and x-ray sensitive film for producing a shadow graphic picture of the internal structure or condition of the subject. More recently, radiographic detectors have been embodied by cellularized detectors of various types, defining an area expanse and including many individual detectors each responsive to radiation incident upon its particular zone. See for example, U.S. Pat. No. 4,626,688, issued on Dec. 2, 1986 to Barnes, which is hereby expressly incorporated by reference.

Other techniques for imaging the internal structure or condition of a subject by use of penetrative radiation include computerized tomographic scanning and nuclear camera imaging, both of which are well known in the art, and which will not be discussed in detail here.

Some radiation imaging systems employ automatic exposure control. In a traditional means of automatic exposure control radiography, for example, a feedback signal is produced which is a function of the level of x-ray exposure taking place over time. An x-ray sensor, sometimes called a "paddle", is mounted in the vicinity of the x-ray sensitive means such as near or on a cassette holding a screen/film assembly. The sensor sometimes has comprised a photomultiplier tube which produces a voltage which is a function of the instantaneous level of x-ray energy incident upon the receiving face of the tube. Integrating circuitry is provided and coupled to the photomultiplier tube, which, in response to the tube's reaction to x-rays, produces a voltage signal which is a function of the time integral of x-ray energy which has been incident on the tube during the exposure.

This integrated signal forms a ramp signal which is used to control the exposure by comparing it to a fixed threshold reference value. The exposure is allowed to run until the value of the ramp signal exceeds the reference value, or until a maximum predetermined interval of time has elapsed, whichever comes first. This predetermined time is commonly referred to as a "backup time". The backup time value is often set to a time of several seconds or more, a time of five (5) or six (6) seconds being common.

Alternately, it is also known to preprogram a radiographic system to terminate the exposure only upon lapse of a certain predetermined exposure time less than the backup time.

The ramp signal/backup time exposure control technique suffers from the disadvantage that, if radiation reaching the sensor or paddle is insufficient to increase the integrated radiation indicating ramp signal to the predetermined exposure termination threshold level prior to expiration of the backup time, the exposure will continue until the backup time runs out, without regard to the fact that, if the ramp signal is not increasing with sufficient speed, a poor exposure is likely being made. Thus, the patient is subjected to a dose of radiation for the entire backup time, only to learn later that the exposure was inadequate and would have to be performed again after corrective measures.

At least two conditions can contribute to the failure of sufficient increase in the integrated radiation accumulation ramp signal. First, that ramp signal will not increase with sufficient speed if the screen/film cassette is not properly aligned in the x-ray beam from the source, since the radiation sensing paddle is usually mounted on or quite near the cassette itself. Thus, if the source is moved to a position over the patient's chest, and the cassette moved to a location under his abdomen, actuation of the source will cause the propagation of x-rays through the patient's chest for the full backup period of several seconds without yielding any picture at all. The dose will thus have been wasted, and the patient would have to be re-exposed to the radiation this time with the cassette properly aligned.

Another condition which can result in excessively slow ramp signal buildup is where the radiation system, while properly aligned, is not adjusted for proper radiation emission level. If, for example, a large patient were to be imaged, but the source was preset for delivering radiation of only sufficient intensity to image a small patient's body, the radiation might likely continue for the entire backup time without raising the ramp signal to the threshold level to induce exposure termination. Under these circumstances, it is likely that the film obtained will be insufficiently exposed, which will, as in the previous case of misalignment, result in the necessity for re-exposing the patient to more radiation to make a second exposure following a failed first exposure which endured for the entire length allowed by the backup timer.

Details of known automatic exposure control are illustrated in the U.S. Patent to Slagle and in the U.S. patent application to Griesmer, both fully identified below and hereby expressly incorporated by reference.

An object of this invention is to provide exposure control for radiographic imaging which monitors the cumulative progress of an ongoing exposure and aborts the exposure automatically in the event that the exposure appears from its early progress to be a likely failure.

DISCLOSURE OF INVENTION

The disadvantages of the prior art are reduced or overcome by use of a radiation imaging system including a radiation source and a radiation responsive imaging means spaced from the source and aligned with radiation propogated from the source when actuated, such that the radiation responsive imaging means produces a representation of a pattern of radiation emergent from a subject located at an examination station between the source and the radiation responsive imaging means. The system also includes a radiation sensor located proximate the imaging means which is coupled to means for producing an electrical signal representing the integral of radiation detected by the sensor during an exposure. This integral representing signal substantially defines a ramp.

Rather than waiting for a poor exposure to run its course, the system of this invention monitors the progress of radiation accumulation during the exposure by periodically checking to determine whether the ramp signal is increasing at a predetermined rate with respect to time. This condition is referred to as a "ramp moving" condition.

The system further includes means for aborting or terminating the exposure in response to the failure of the monitoring means to detect the ramp moving condition. Such termination results in the reduction of administration of radiation to the patient or subject where the monitoring indicates that the exposure is likely to be poor, and indicates the need for readjusting the system and restarting the exposure.

In accordance with a more specific aspect, the monitoring is carried out in real time, during the actual exposure, affording the possibility that, if the exposure appears, early on, likely to be poor, it can be terminated early in the cycle, saving the subject from the administration of unnecessary radiation. The embodiment of the present invention provides for immediate termination upon fault detection, as opposed to the backup time concept, in which the patient can receive unnecessary radiation dose even though the ongoing exposure is likely to be poor or useless for providing diagnostic information.

The purpose of the present invention is to detect an improper x-ray exposure while operating under automatic exposure control and terminating that exposure early in its cycle to prevent unnecessary radiation dose and procedural time loss. In the prior art automatic exposure control, the exposure has been allowed to go to completion or to expiration of backup time and any error in equipment setup by an operator, or any equipment malfunction, is not revealed until the exposed film is developed. This results in wasted radiation exposure to the patient and potential repeated re-takes of subsequent exposures until it is realized by the operator that there is indeed equipment or procedural malfunction.

This invention is embodied by means for sampling the automatic exposure control (AEC) ramp signal and to compare it to a reference voltage pattern scaled down to a fraction of the normal AEC reference voltage and to develop an early warning hardware signal which is susceptible of use to terminate the exposure in the early phase of the exposure cycle if the ramp has failed to reach its predetermined desired level for that point in the exposure cycle. In actual practice means is provided for continual checking of the AEC ramp utilizing, in a specific embodiment, hardware or a microcomputer to sample and analyze the ramp signal.

In accordance with a specific embodiment, after the exposure begins, and continuing until the exposure terminates, a timer is initiated every 330 milliseconds. When the time on the timer has elapsed, the AEC ramp signal is passed through an analog to digital converter and sampled. If the ramp is sensed to be in a "not moving" condition, the exposure is terminated and the operator is warned, via an operator panel displayed error code, of the failure of the ramp signal to increase with the desired speed.

In a more specific embodiment, the ramp "not moving" condition is indicated in response to the failure of the ramp signal to increase by at least 40 millivolts during the 330 millisecond measured time interval.

This invention is, however, not limited to use in connection with automatic exposure control mode. Even where the radiation imaging system employed is of the timed exposure variety, not normally calling for a ramp signal, means for providing a ramp signal can be utilized and embodiments of the present invention can be employed to continually monitor the progress of the exposure through its entirety, and can be used to terminate the exposure at an easy point in its cycle if equipment malfunction or maladjustment appears to render the exposure of poor quality.

This invention will be understood more fully and in more detail by reference to the following description, and to the drawings, in which:

BRIEF DESCRIPTION OF THE DRAWINGS

FIG. 1 is an elevational view of a radiation imaging system incorporating the present invention;

FIG. 2 is a detail view of a portion of the system illustrated in FIG. 1;

BEST MODE FOR CARRYING OUT THE INVENTION

Figure 3A:
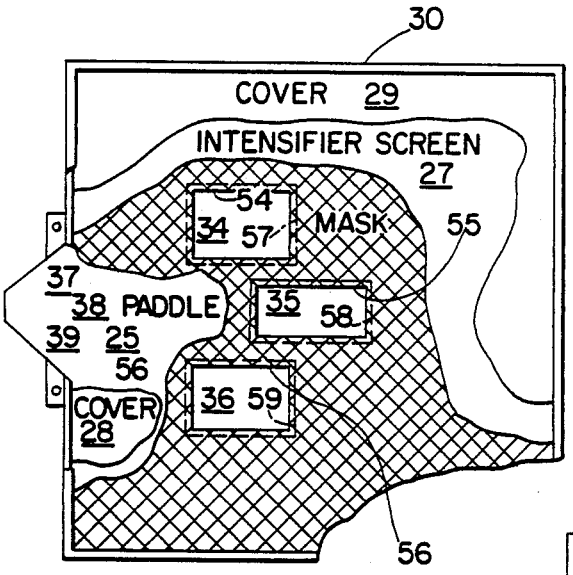
FIG. 3A is a detail view of the assembly of FIG. 2 with portions thereof broken away.

Referring to FIG. 1, an x-ray apparatus is shown generally at 10. The apparatus includes an x-ray tube, not shown, mounted within a tube housing 11. The tube and the housing 11 are supported in an operative position by a suitable supporting structure 12.

A subject supporting table 13 is disposed beneath the tube housing 11. The position of a subject to be examined is indicated in broken lines generally at 14. The x-ray tube emits x-rays in a beam emanating from a focal spot shown schematically at 15 and the x-rays are directed toward the subject 14 positioned on the table 13.

A Bucky assembly 16 is positioned beneath the table 13. The Bucky assembly 16 is equipped with a usual reciprocable grid 17 and a cassette or film tray 18. An x-ray sensitive film 19 is positioned within the film tray 18 such that x-rays passing through the subject 14 will cast a shadow which is recorded by the film 19.

A phototimer housing 20 is secured to the top and one side of the Bucky assembly 16. Referring to FIG. 2, the phototimer housing 20 defines first and second adjacent compartments 21, 22. The first compartment 21 houses a suitable light responsive electrical control element such as a phototube 23. The second compartment 22 houses a light emitting assembly 24 which, as will be explained in greater detail below, includes a fluorescent screen and a plurality of panels which transmit light to the phototube 23.

Figure 3:
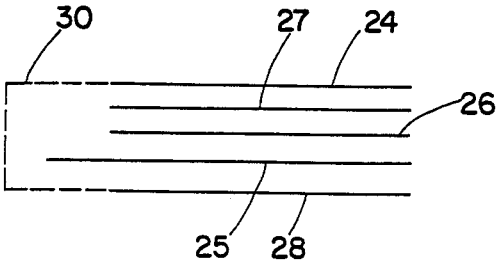
FIG. 3 is another detailed view, in elevation, of the system of FIG. 1.

Referring to FIG. 3, and 3A the construction of the assembly 24 is more clearly shown in an exploded end view. A paddle structure 25 is positioned centrally with respect to the assembly 24 and comprises a plurality of juxtaposed panels. The paddle structure 25 along with a paddle mask 26 and an intensifier screen 27 are sandwiched between upper and lower cover plates 28, 29. The cover plate 28 is referred to as the upper cover plate in that it is positioned facing upwardly adjacent the Bucky tray 16. A frame assembly 30 receives and surrounds the sandwiched assembly 24.

Details of the paddle structure described above, and its utilization for controlling x-ray tube exposure output, are described in more detail in U.S. Pat. No. 3,752,991, issued on Aug. 14, 1973 to Slagle, U.S. patent application Ser. No. 893,573 filed Aug. 4, 1986 by Morgan et al. & entitled "Improved Photoining Method & Apparatus", the disclosures of which are hereby expressly incorporated by reference.

In practice, the photomultiplier tubes sense the incidence of x-rays on the cassette or film tray. Known circuitry coupled to the photomultiplier tube integrates the detected radiation and generates a ramp signal whose instantaneous value is a function of the accumulated radiation during the particular exposure. The system 10 is also equipped with circuitry of known type which terminates the exposure in response to the value of the ramp signal reaching a predetermined level which is preselected to represent the total radiation level desired for the exposure being made. Additionally, the system 10 can incorporate a known form of backup timer which terminates the exposure in any event upon the expiration of a predetermined backup time which, in practice, is known generally as five or six seconds.

The apparatus and circuitry for sensing the radiation, for integrating the radiation sensed, to produce the ramp signal, and for terminating the exposure when the ramp signal reaches a predetermined level, is well known in the art, as is exemplified for example in U.S. Pat. No. 3,600,584 to Schneble, which is expressly incorporated by reference. Phototiming control circuitry is also described in detail in U.S. patent application Ser. No. 893,574, filed Aug. 4, 1986 by Griesmer, et al. and entitled "Improved Phototiming Control Method and Apparatus", which is also expressly incorporated herein by reference.

Figure 4:
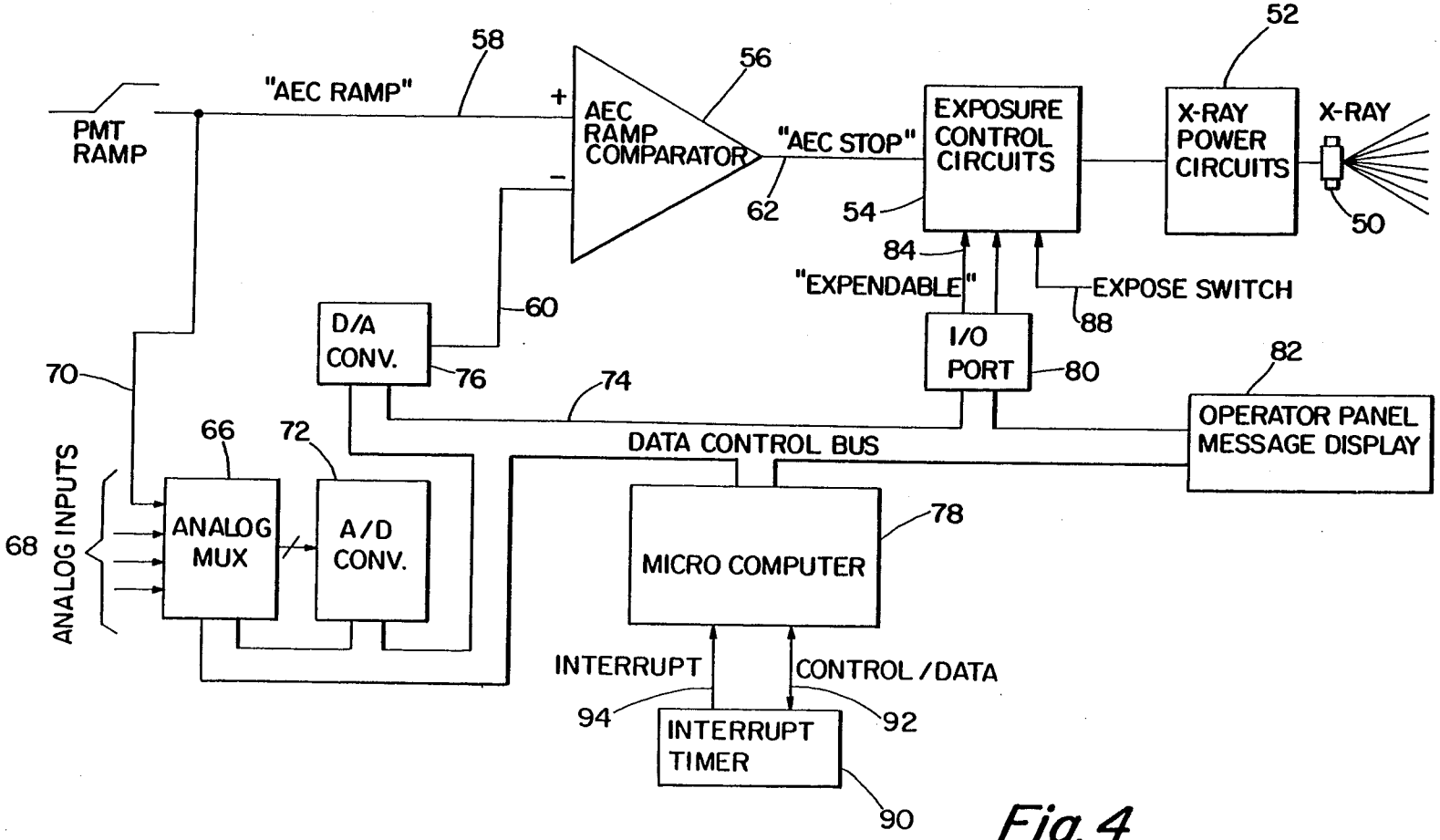
FIG. 4 is a block diagram illustrating operation of aspects of the system of FIGS. 1–3.

FIG. 4 illustrates in block form components of the system described in connection with FIGS. 1–3. More specifically, the x-ray tube is shown at 50 in FIG. 4. The x-ray tube is actuated by x-ray driver circuits 52 of known design. The driver circuits 52 are actuated by exposure control circuitry 54, which enables the x-ray driver circuits 52 in response to various combinations of inputs, each input indicating a system condition or command control circuitry.

A comparator 56 has two inputs. One of the inputs is the ramp signal, mentioned above, which appears at a lead 58. The other input is an analog signal representing the desired maximum reference value for the ramp signal, the reference signal appearing at a lead 60. In operation, when the ramp signal at the lead 58 becomes equal to the reference signal at the lead 60, the comparator 56 produces a stop signal at the lead 62 to the exposure control circuits which causes the exposure control circuitry to terminate the x-ray exposure.

FIG. 4 illustrates an analog multiplexer circuit 66 which receives a number of analog inputs 68, including an analog input over a lead 70 corresponding to the ramp signal. An output from the analog multiplexer 66 is fed as an input to an analog to digital converter 72.

The analog multiplexer 66 and analog to digital converter 72 are connected to one another, and to other components of the system, by a data and control bus of known design and indicated at reference character 74. More specifically, the data bus 74 couples together the following components: the analog multiplexer 66; the analog to digital converter 72 a digital to analog converter 76; a microcomputer 78; an input/output port 80, and an operator panel 82.

The digital to analog converter 76 receives as an input a digital representation of the automatic exposure control reference threshold signal, which is the signal representing the maximum value to which the ramp is allowed to rise prior to exposure cut-off. The converter 76 converts this digital signal to the analog signal mentioned above appearing at the lead 60 as an input to the comparator 56.

Ultimately, the value of the signal at the lead 60 is governed in known fashion by a selection made at the operator panel 82.

The input/output port 80 has an output to the exposure control circuitry 54. The output, at a lead 84, conditions the exposure control circuitry to terminate or to enable the generation of x-rays.

Additionally, exposure is enabled by the presence of a signal on an expose switch lead 88, which is actuated by an operator.

Therefore, in order for an exposure to be maintained, there must be a signal at the lead 88, the lead 84, and the lead 62 must be conditioned to permit the exposure control circuitry to allow actuation of the x-ray power circuits 52.

The condition of the signal at the lead 84 of the input/output port 80 is determined by operation of the microcomputer 78. The microcomputer receives, over the bus 74, a digital signal corresponding to the substantially instantaneous value of the ramp signal appearing at the lead 70. The microcomputer 78 also contains timing and sampling means.

Stated simply, the present invention involves sampling the ramp signal, such as appearing at the lead 70, and comparing it to a reference voltage which corresponds to the value of a ramp signal increment which would be expected during the most recent sampling time interval if all the equipment were properly aligned and functioning normally. This comparison is used to develop an "early warning indicator" signal to abort the exposure in its early phase if the actual sensed ramp signal at any point in its progress, failed to reach its expected limit.

More specifically, this invention involves continually checking on the automatic exposure control ramp signal using the microcomputer 78 to sample and analyze that ramp signal. In practice, after the exposure begins, and continuing until the exposure terminates, a timer means, which is part of the microcomputer, is initiated every 330 milliseconds. When the time on the timer has elapsed, the automatic exposure control ramp signal is passed through the analog to digital converter and its digital expression of the ramp value is sampled. The analog to digital converter 72 is an 8 bit converter having a 10 volt scale such that a change of 40 millivolts in the ramp signal will result in a one bit change in the converter output. If the ramp signal is sensed to be in a "not moving" or "insufficiently rapidly moving" condition, i.e., the ramp is not increasing as fast as would normally be expected in the instance of a proper exposure with a properly adjusted system, the exposure is aborted and the operator is warned via the operator panel 82 producing a code indicating a particular system malfunction involving the insufficient increase in the ramp signal.

The microcomputer 78 also interfaces with an interrupt timer 90. The time control and data information from the microcomputer over a lead 92, and transmits information to the microcomputer over the same leads. Additionally, the interrupt timer 90 produces an interrupt signal at a lead 94 directed to the microcomputer 78.

Figure 5:
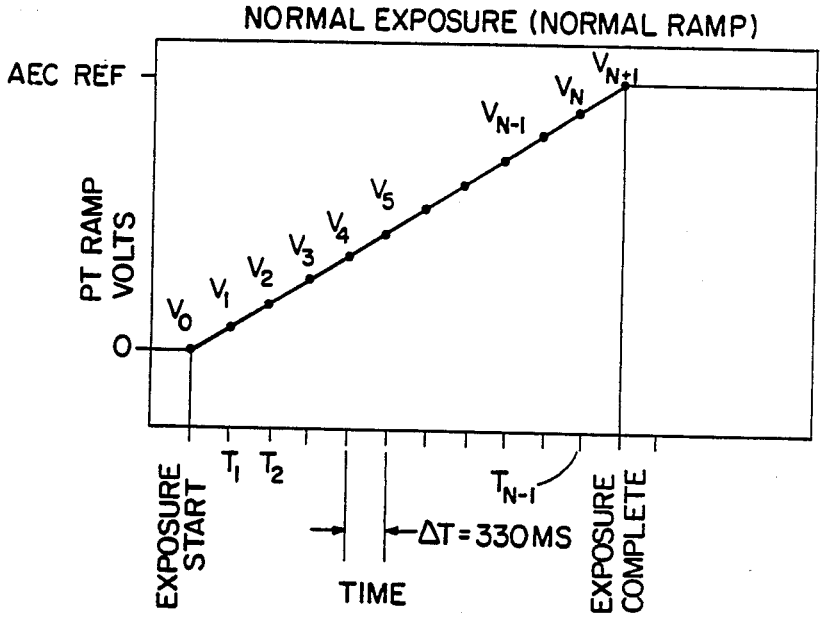
FIGS. 5–7 are graphical representations of operation of the system of the present invention.

FIG. 5 depicts a normal exposure sequence. Samples are taken after each time delay of 330 milliseconds. Each voltage sample is then compared to the previously sampled voltage for a minimum change of at least 40 millivolts, (i.e., one bit) which is considered a valid criterian of a ramp moving condition. The exposure progresses routinely until the ramp voltage exceeds the automatic exposure control reference, at which point the exposure is normally terminated by assertion of the stop signal by the comparator to the exposure control circuitry.

In FIG. 5, where $V_1$, $-V_0$, $V_2$-$V_1$, $V_3$-$V_2$, . . . $V_N-V_{N-1}$ are each greater than 40 millivolts, indicating a ramp moving condition, the exposure continues. When $V_{N+1}$ is reached, a ramp stop is indicated, and the exposure is terminated. Similar conditions pertain with respect to the ramp graph shown in FIG. 7, discussed below.

Figure 6:
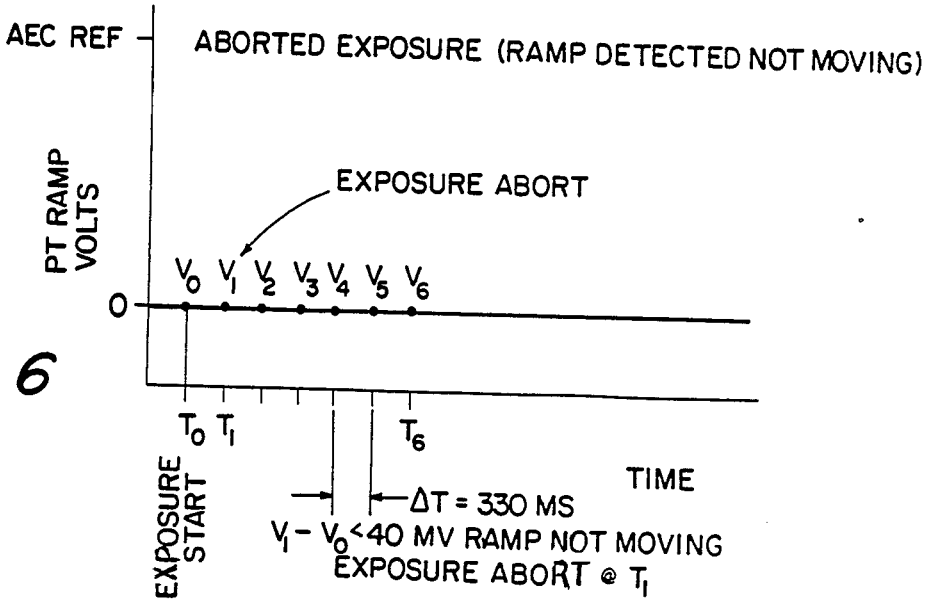

In FIG. 6, the exposure was aborted after the first sample point, at which time it was determined by implementation of the present invention that there was substantially no change in the ramp voltage, i.e., less than 40 millivolts of change. In previous practice of the prior art, the exposure would have continued until the back-up time had elapsed, which would have been several seconds longer, and the patient would have been needlessly exposed to radiation which was not going to yield a diagnostically useful x-ray image.

Figure 7:
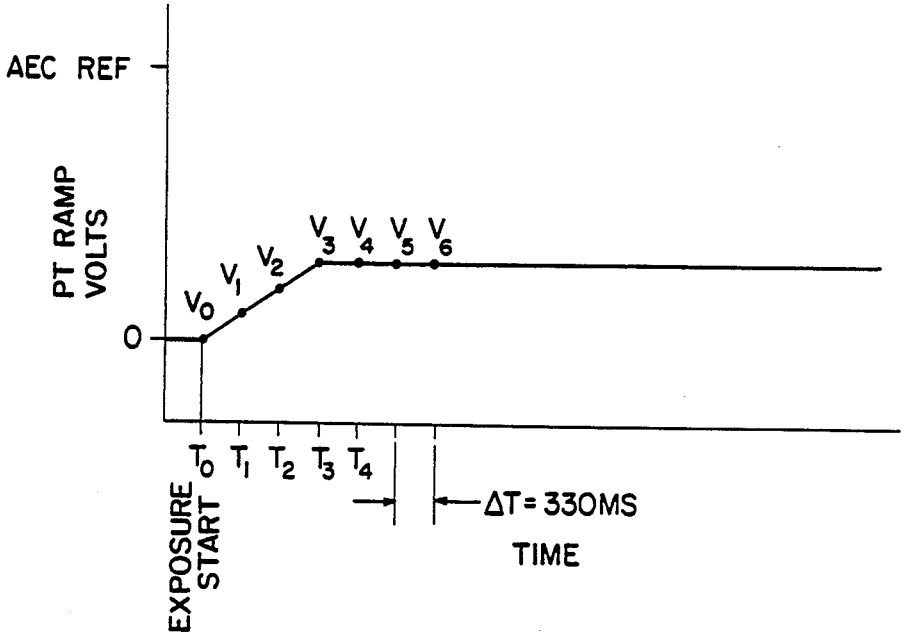

FIG. 7 shows a normal exposure beginning to progress, followed by a fault condition in the ramp signal which was sensed by the implementation of this invention and the exposure was immediately aborted, eliminating the administration of unnecessary x-ray exposure to the patient.

It should be understood that this invention is not limited to radiographic systems which operate in automatic exposure control mode, with the exception at an upper limit on the rate the ramp is moving may be set as well. Rather, this invention can be directed to radiographic systems operating under manual fixed time exposure control, to the extent that such systems are equipped with means for producing the ramp signal as described above. Operation of the invention is identical to that taking place in the automatic exposure control mode. The system will terminate an exposure after the first sample period in which it detects failure of the ramp to increase by a predetermined value, or if the ramp is increasing more rapidly than desired. If no faulty ramp condition is sensed, then the exposure will terminate at the regular fixed time selected for the exposure. In this configuration, the present invention may act as an exposure override, i.e., if the exposure time is erroneously set too long, the invention will interrupt the exposure at a properly timed out value, less than the set value.

Both the sample time interval and voltage change difference selected to sense and determine whether the ramp is rising with sufficient speed can be varied or tailored to system parameters for both automatic and fixed exposure time applications.

Figure 8A:
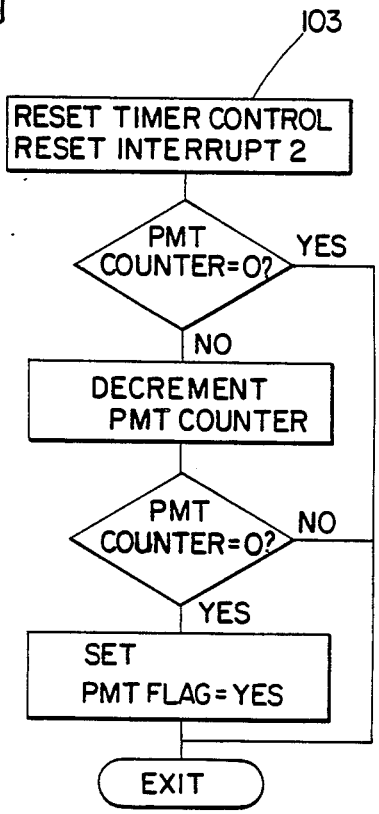
FIG. 8 and 8A are flow charts illustrating in more detail operation of a portion of the system as illustrated in FIG. 4.
Figure 3A:
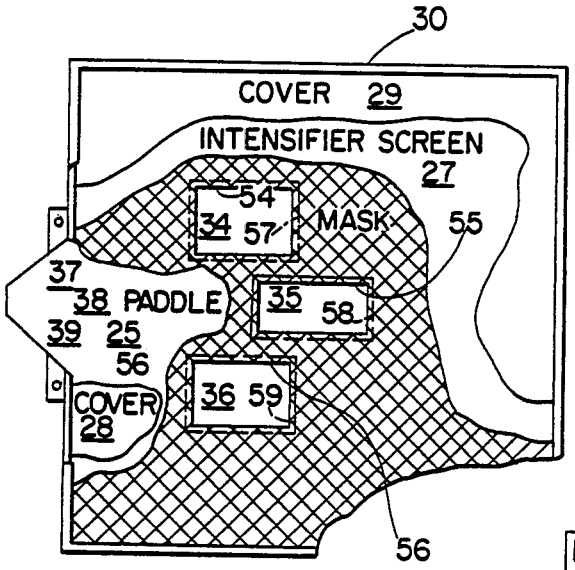
Figure 3:
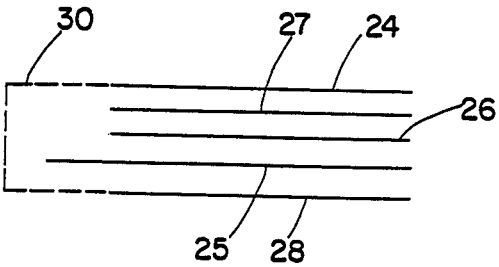
Figure 8A:
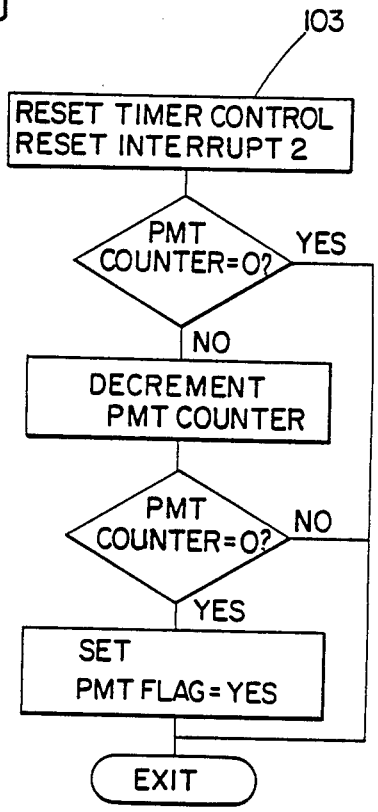
Figure 8:
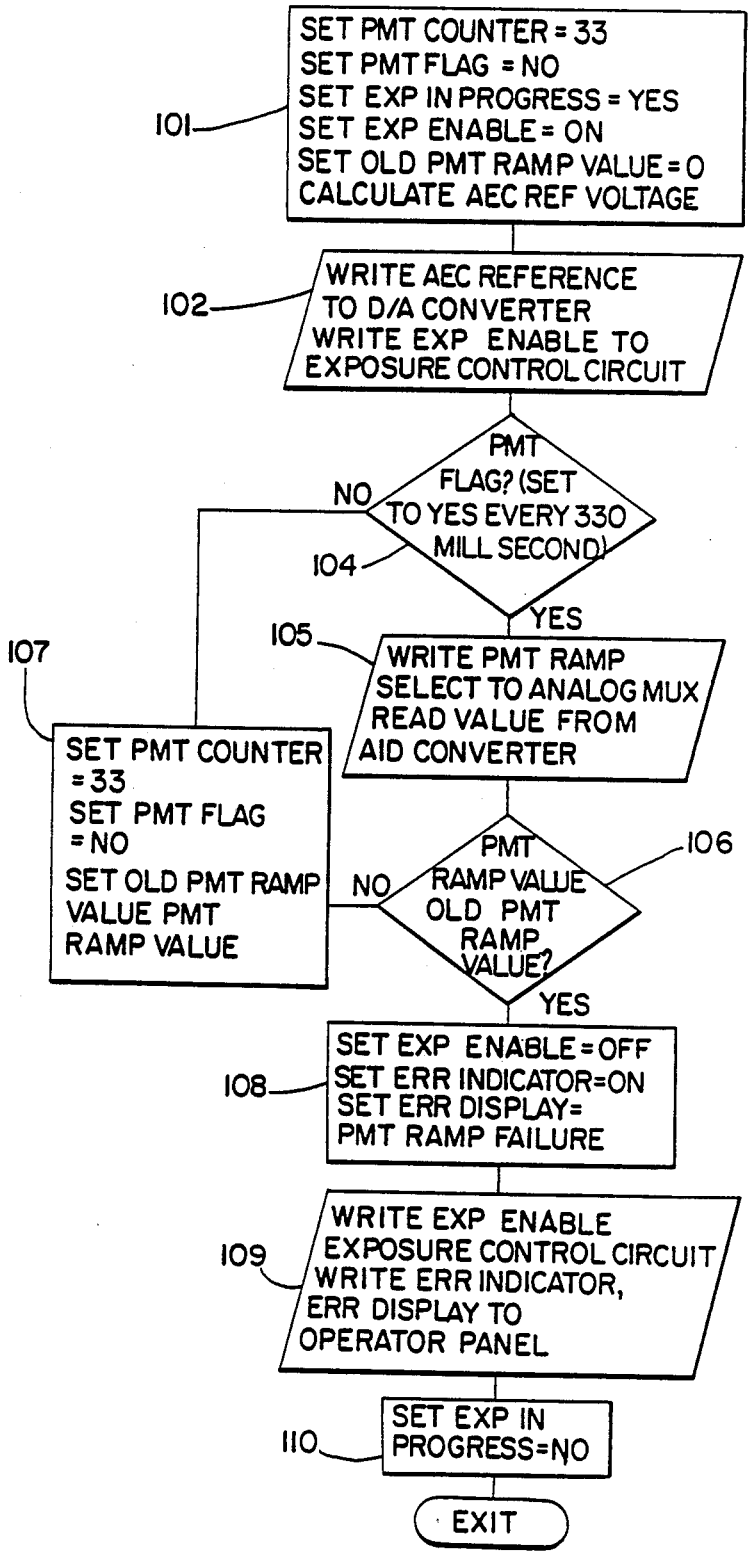

While the foregoing description of FIGS. 1-4 and the operational graphs of FIGS. 5-7 are sufficient for the person of ordinary skill in this art, a flow chart of microcomputer operation is set forth in FIG. 8 for those not conversant with the art.

FIGS. 8 and 8A are flow charts indicating the operation of the microcomputer 78 and interrupt timer 90, in conjunction with the other components of the radiographic system.

Referring to the component 101, when an automatic exposure is requested by the appearance of an appropriate signal at the lead 88, the microcomputer initializes values for appropriate counter, flag and ramp signals. The microcomputer also calculates the fixed threshold reference value and sets the exposure enable signal to "on". Referring to block 102, the threshold reference value, i.e., the maximum value which the ramp will be allowed to attain, is written to the digital to analog converter 76. This analog voltage is used as a reference value which is compared to the ramp signal in the comparator 56 to generate the automatic exposure control stop signal which provides normal termination of exposure upon the ramp reaching its predetermined allowed maximum. The exposure enable signal is then written to the exposure control circuitry by way of the input/output port 80 allowing the exposure to begin.

Referring to block 103, the interrupt timer 90 is initialized when the system is powered on, and preempts the exposure control timing function whenever 10 milliseconds have elapsed and, at that time, will compare the counter (within the microcomputer) value to zero. If the counter value equals zero, then further processing is stopped. If the counter value is not equal to zero, then the counter is decremented and compared again to zero. If the counter at that point has reached zero, then a flag signal is set equal to "yes". If the counter has not yet reached zero, then further processing is stopped until the ten millisecond interval elapses and the process repeated until the counter reaches zero.

Referring to block 104, whenever the flag is set to its "yes" condition, 330 milliseconds have elapsed, and processing can continue.

Referring to block 105, the value which selects the AEC ramp 70 is written to the analog multiplexer 66 and then to the analog to digital converter 72. When the conversion is completed, the bus 74 is read (block 106) for the digital representation actual ramp value. This representation is compared to the old, last sampled representation, and if the two values are not equal, (differ by one bit) which means the exposure is working correctly, then the timer is re-initialized (block 107) to time for another 330 millisecond delay. The formerly sampled ramp digital representation is reset to the most recently sampled digital representation.

Referring to block 108, if the digital representations read are equal, an error condition has been sensed, and the exposure is terminated. This (block 109) is accomplished by setting the exposure enable signal to off, and writing it to the exposure control circuits 54. To alert the operator to the condition, an error information signal on an error display for the operator panel 82 will be lighted.

This having been accomplished, the block 110 shows the re-setup of the equipment for a new exposure.

It is to be understood that the disclosure of the present invention is intended as illustrative, rather than exhaustive, of the invention. Those of ordinary skill may be able to make certain additions or modifications to, or deletions from, the specific embodiments described herein without departing from the spirit or the scope of the invention as defined in the following claims.

We claim:

1. A radiographic system comprising:
(a) an x-ray source for producing, upon actuation, a beam of x-rays;
(b) an x-ray sensitive means spaced from said source and positionable in said beam of x-rays;
(c) means for producing a signal representing a cumulative amount of radiation incident upon said radiation sensitive means;
(d) means for sampling said cumulative signal at predetermined time intervals;
(e) means for comparing change in value of said signal between consecutive samplings to a predetermined value, and
(f) means for de-actuating said x-ray source in response to said comparison of said sampled values indicating a change in said cumulative signal of less than said predetermined amount.

2. The system of claim 1, wherein:
(a) said sampling means samples said cumulative signal at approximately 330 millisecond intervals, and
(b) said predetermined amount is approximately 40 millivolts.

3. The system of claim 1, further comprising:
means for de-actuating said x-ray source in response to said comparison of said sampled values indicating a change in said cumulative signal of more than a second predetermined amount.

4. The system of claim 1, further comprising:
means for adjusting the duration of at least one of said predetermined time intervals.

5. The system of claim 1, further comprising:
means for adjusting said predetermined value.

6. A penetrative radiation imaging system comprising:
(a) a penetrative radiation source for producing a beam of penetrative radiation for a radiation exposure of an object to imaged;
(b) means responsive to said radiation for imaging said object and positionable in said beam and spaced from said source;
(c) means for repetitively monitoring and indicating the amount of penetrative radiation incident upon said radiation responsive means during said radiation exposure;
(d) means for repetitively comparing said indications with criteria indicating an acceptable rate of change in the amount of said radiation value, and,
(e) means for terminating radiation exposure in response to failure of said indications to meet said criteria.

7. A penetrative radiation imaging system comprising:
(a) a penetrative radiation source for producing a radiation exposure of an object to be imaged;
(b) a penetrative radiation detector for imaging said object plurality;
(c) means for monitoring and quantifying, a plurality of times, radiation incident upon said detector during said moderation exposure, and
(d) means for aborting said radiation exposure in response to failure of said monitored radiation to achieve a predetermined rate of change in value.

8. A penetrative radiation imaging system comprising:
(a) a penetrative radiation source;
(b) a penetrative radiation responsive imaging means spaced from the source and aligned with radiation propagated from said source when actuated such that the radiation responsive imaging means produces a representation of a pattern of radiation emergent from a subject when the subject is located at an examination station between the source and the radiation responsive means;
(c) a radiation sensor located proximate said radiation responsive imaging means, said sensor being coupled to means for producing an electrical signal representing a time integral of radiation detected by said sensor over an exposure time, said signal being configured substantially as a ramp signal;
(d) means for monitoring the progress of said ramp signal during radiation production and for repeatedly checking during said exposure time to determine whether said ramp signal is increasing at substantially a predetermined rate with respect to time, and
(e) means responsive to failure of said ramp to increase by said predetermined rate, said means being operative in response to said failure to deactuate said penetrative radiation source.

9. The system of claim 5, wherein said monitoring means includes means for achieving said monitoring in real time during an actual radiation exposure.

10. A penetrative radiation imaging system comprising:
(a) a penetrative radiation source for producing a radiation exposure of an objection to be imaged
(b) a penetrative radiation detector for imaging said object;
(c) means for monitoring and quantifying penetrative radiation incident upon said detector, and for sampling said quantified radiation at a plurality of intervals during said radiation exposure, and
(d) means for aborting said penetrative radiation exposure in response to failure of said sampled quantified radiation to achieve at least a predetermined rate of change in value.

11. The system of claim 10, further comprising:
means for adjusting said predetermined rate of change in value.

12. The system of claim 10, further comprising:
means for adjusting the duration of at least one of said plurality of intervals.

13. The system of claim 10, further comprising:
(a) means for adjusting the value of said predetermined rate of change, and
(b) a means for adjusting the duration of at least one of said plurality of intervals.

14. A penetrative radiation imaging system comprising:
(a) a penetrative radiation source for producing a radiation exposure of an object to be imaged;
(b) a detector of penetrative radiation for imaging said object;
(c) means for monitoring and quantifying penetrative radiation incident upon said detector a plurality of times during said radiation exposure, and, (d) means for aborting said radiation exposure in response to failure of said quantified radiation to achieve a predetermined rate of changer of value.

15. A radiographic method comprising the steps of:

(a) producing, on command, a beam of x-rays;

(b) detecting a pattern of said x-rays after passage through a subject to form a radiographic image;

(c) producing a signal representing a cumulative amount of said x-rays incident upon an area;

(d) sampling said cumulative signal at predetermined time intervals;

(e) comparing the change in the value of said sampled signal occurring between consecutive samplings to a standard, and (f) deactivating the propagation of said x-rays in response to said comparison of said sampled values indicating a change in said cumulative signal in variance with said standard.

16. A method for imaging utilizing penetrative radiation, said method comprising the steps of:

(a) producing penetrative radiation for imaging said object for a radiation exposure of an object to be imaged;

(b) detecting said penetrative radiation for imaging said object;

(c) monitoring and quantifying penetrative radiation incident upon a predetermined area a plurality of times during said exposure, and (d) aborting production of said penetrative radiation in response to a failure of said quantified penetrative radiation to achieve at least a predetermined rate of change in value.

* * * * *